United States Patent [19]

Ozbey et al.

[11] 4,273,328

[45] Jun. 16, 1981

[54] CHEST MUSCLE AND POSTURE DEVELOPER

[76] Inventors: Suzan N. Ozbey; Amber L. Ozbey; Ahmet M. Ozbey, all of 205 Bonhill Dr., Ft. Washington, Md. 20022

[21] Appl. No.: 46,817

[22] Filed: Jun. 8, 1979

[51] Int. Cl.[3] ..... A63B 21/02

[52] U.S. Cl. ..... 272/137; 272/143; 2/115

[58] Field of Search ..... 272/137, 142, 143, 135, 272/DIG. 4; 2/115

[56] References Cited

U.S. PATENT DOCUMENTS 3,529,820 9/1970 Templeton ..... 272/137

3,819,177 6/1974 Spiro ..... 272/137

4,130,276 12/1978 Tricarico ..... 272/DIG. 4

*Primary Examiner*—William R. Browne

*Attorney, Agent, or Firm*—Sixbey, Friedman & Leedom

[57] ABSTRACT

The chest muscle and posture developer includes an elongated, partially elasticized strip of fabric having at least one arm band attached to each end thereof. The elastic strip stretches length wise across a user's back and exerts a force which draws the arms and shoulders rearwardly. The user counteracts this force through use of the chest muscles, thereby resulting in chest muscle development. The device is easily concealed in clothing and may be attached to a shirt or similar garment.

12 Claims, 5 Drawing Figures

CHEST MUSCLE AND POSTURE DEVELOPER

DESCRIPTION

Background of the Invention

This invention relates to exercising devices for developing muscles, and particularly to exercising units for developing muscles primarily in the chest area.

People frequently desire to employ exercising devices designed to develop certain specific muscles. This development generally involves enlarging muscular capacity by increasing the size of the muscles as well as the muscle tonicity.

Many women are desirous of developing a prominent breast profile. Since the human chest muscles, particularly pectoralis major and minor, are located under the female breast, development of these muscles results in an enlarged breast profile.

Prior art devices for breast and chest muscle development are known, but such devices cannot be concealed during use. Furthermore, these known devices require that a user exercise in a deliberate manner, applying a conscious effort to accomplish the exercise. For example, one popular device consists of two half-shells held apart by a spring mechanism. In order to exercise with the device, the user must press the half-shells together.

U.S. Pat. No. 1,432,013, shows an exercising device which stretches across the back and extends to a user's hands. This device would be difficult to conceal under clothing, and requires a deliberate, conscious effort for use. Additionally, this patented device tends to develop the arm muscles which may be undesirable for female users. Although many women exercise to develop posture and the muscle of the chest, muscular arms are not considered to be a female attribute.

Prior art devices for breast and muscle development have, while in use, increased the user's body heat production, thus causing user discomfort. Furthermore, to the extent that prior art devices enclose the user's body, such discomfort is increased by inhibiting transpirational cooling.

Finally, prior art exercise units require a user to discontinue other activities and devote time solely to the use of such devices for exercise purposes.

SUMMARY OF THE INVENTION

A primary object of this invention is to provide a device for developing a user's posture and chest muscles without conscious effort on the part of the user.

A further object of this invention is to provide a device for developing a user's chest muscles which is normally concealed easily under a user's clothing, and which may be employed unconsciously during the performance of daily tasks.

Another object of this invention is to provide a device for developing a user's chest muscles without deliberate effort on the part of the user; such device being designed to insure user comfort during use.

A further object of this invention is to provide a device for developing a user's chest muscles while improving posture and poise.

Another object of this invention is to provide a novel garment for chest muscle exercise and enhanced user comfort.

Further objects and features of the invention will become readily apparent from a consideration of the following specification and claims taken in conjunction with the accompanying drawings.

BRIEF DESCRIPTION OF THE DRAWINGS

Referring now to FIGS. 1 and 2, a preferred embodiment of the chest muscle and posture developer of the present invention indicated generally at 10 includes circular arm bands 12 and 14 which are secured to first and second back sections 16 and 18. The arm bands may be permanently affixed to the back sections by conventional means, such as stitching, or alternatively, the arm bands may be removably secured to the back sections by conventional fasteners such as snaps, hooks or zippers.

Figure 1:
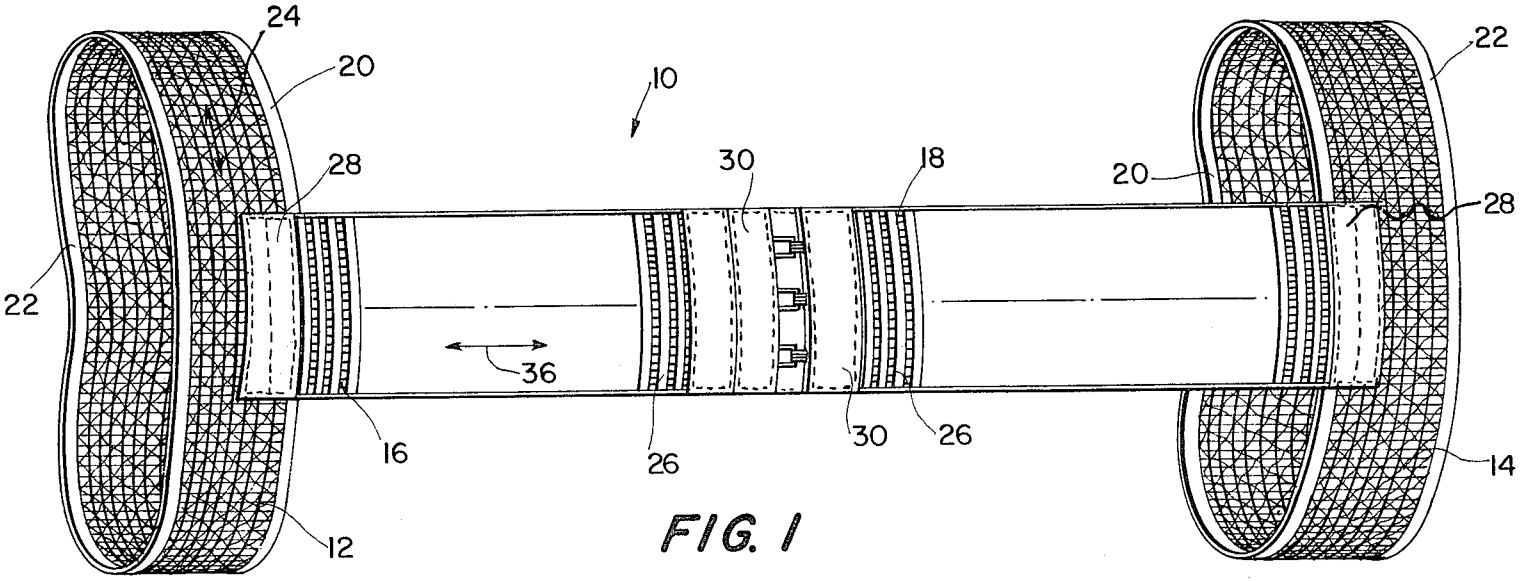
FIG. 1 is a perspective view of the chest muscle and posture developer of the present invention.

The arm bands 12 and 14 are preferably constructed primarily of strips of elasticized material having an open web or net-like structure to provide high porosity. This porosity of the arm bands improves comfort by facilitating the natural transpirational cooling of a user. The strips forming the arm bands are reinforced along the outermost edges thereof by solid bands of elasticized material 20 and 22. The material forming the circular arm bands 12 and 14 is designed to stretch along an axis parallel to the reinforcing strips 20 and 22 as indicated by the double arrows 24 in FIG. 1. However, the arm bands are designed so that there is substantially no elasticity in a direction perpendicular to the axis indicated by the arrows 24.

The first and second back sections 16 and 18 each include an elongated strip of elastic material 26 which, like the elastic material forming the arm bands 12 and 14, is porous to facilitate natural transpirational cooling. A section 28 of in elastic reinforcing material is secured to one end of each of the first and second back sections 16 and 18 respectively. This reinforcing section 28 is then stitched or otherwise attached to the connecting circular arm band 10 or 12.

The remaining free ends of the first and second back sections 16 and 18 are secured to in elastic sections 30. These in elastic sections support cooperating fastener units of known conventional types. For example, in FIG. 2 these fastener units are depicted as hooks 32 on the back section 18 which cooperate with eyes 34 on the back section 16. It will be noted that the eyes 34 are formed in parallel rows so that the distance between the arm bands 12 and 14 can be adjusted.

The elastic strips 26 are substantially wider than the arm bands 12 and 14 and are designed to stretch longitudinally in the direction of the double arrows 36 while permitting substantially no expansion in the direction perpendicular to that indicated by the arrows 36. Thus it will be seen that the first and second back sections 16 and 18 expand in a direction which is substantially perpendicular to the direction of expansion of the arm bands 12 and 14.

To use the chest muscle and posture developer 10 of the present invention, the user connects the back sections 16 and 18 so that the combined back sections are of such a length that they will tend to draw back the shoulders of a user when the upper arms are inserted into the arm bands 12 and 14. The arm bands are arranged so that the attached back sections 16 and 18 extend across the back of a user in the area of the shoulder blades. Thus, with the chest muscle and posture developer in place, a user may counteract force urging the shoulders rearwardly by using the pectoralis major and minor to thrust the shoulders forwardly and expand the back sections 16 and 18. Repeated action of this type tends to exercise and enlarge the pectoralis major and minor.

Figure 2:
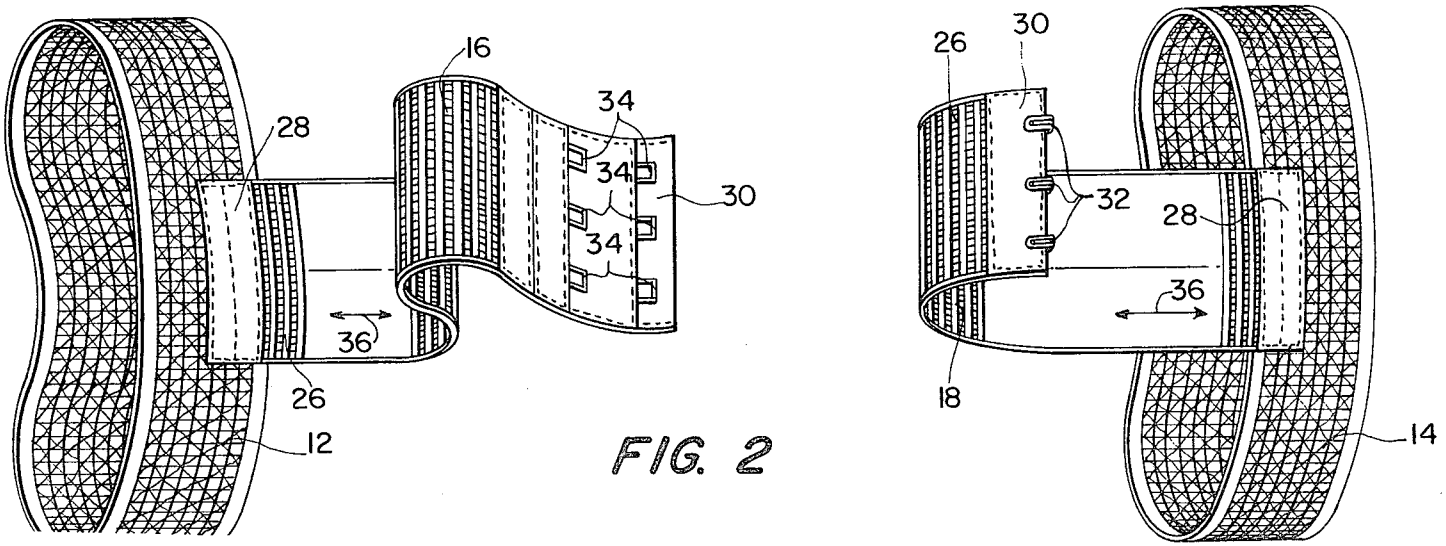
FIG. 2 is a perspective view showing the sections of the invention of FIG. 1.

It will be apparent that the chest muscle and posture developer 10 of FIGS. 1 and 2 may be worn comfortably beneath the clothing of a user and consequently will exercise the muscles of a user as normal daily tasks are performed. The posture of the user is enhanced by the tendency of the device to draw the shoulders rearwardly, while any forward movement of the arms or shoulders will exercise the chest muscles. However, since the arm bands 12 and 14 are positioned about the upper arms of the user, the device does not substantially exercise and enlarge the arm muscles.

From a consideration of FIG. 1 it will be noted that the two back sections 16 and 18 could be combined to form a single elastic strap extending between the arm bands 12 and 14. In this case, the single back strap might be formed to different lengths and consequently be non-adjustable, or alternatively a clamping unit may be employed to double over a portion of the back strap and adjust the length between the two arm bands.

Figure 3:
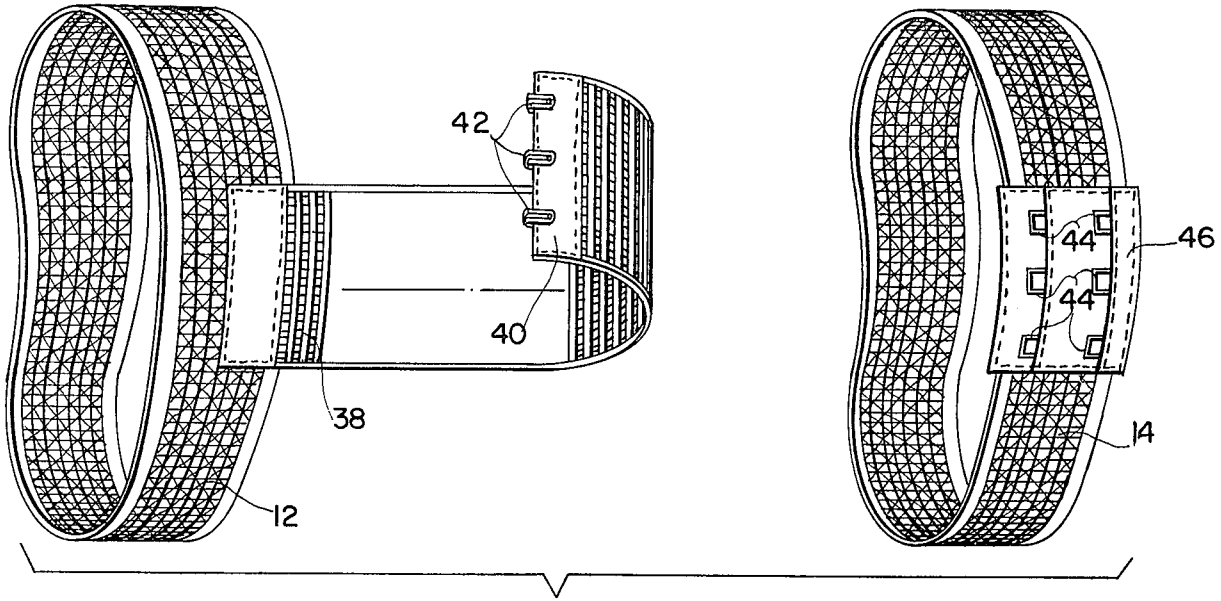
FIG. 3 is a perspective view of a second embodiment of the chest muscle and posture developer of the present invention.

Another structure to facilitate adjustment of the distance between the arm bands 12 and 14 when a single elastic back strap is employed is illustrated by FIG. 3. Here, a single back strap 38 has one end permanently secured to the arm band 12 in the manner previously described. The free end of the strap 38 bears a non-elastic section 40 which mounts a plurality of hooks 42. These hooks in turn cooperate with parallel rows of eyes 44 which are secured to the arm band 14. These eyes may be mounted upon a non-elastic strip 46 or may be secured to the arm band 14 in any other conventional manner. Obviously the hooks 42 and eyes 44 may be replaced by any conventional fastening means which will allow the back strap 38 to be secured to the arm band 14 in such a manner as to adjust the distance between the arm bands 12 and 14.

Figure 4:
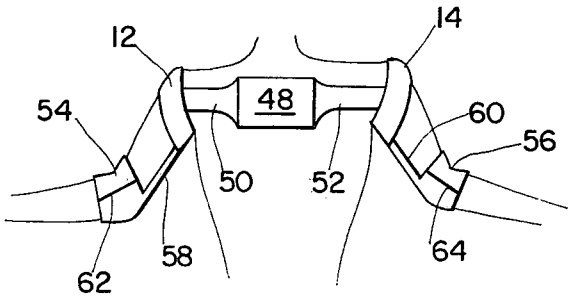
FIG. 4 is a front elevational view of a third embodiment of the chest muscle and posture developer of the present invention.

Referring now to FIG. 4, an alternate embodiment of the chest muscle and posture developer is illustrated wherein the arm bands 12 and 14 are joined to a central elastic section 48 by inelastic straps 50 and 52. The distance between the arm bands 12 and 14 may be adjusted in the manner previously disclosed by having either of the straps 50 or 52 provided with hook members which cooperate with corresponding rows of eye members provided upon either the elastic section 48 or one of the arm bands 12 or 14.

A large elastic pad of the type illustrated by the section 48 which is positioned at substantially shoulder blade level in the center of the back provides a very strong resistance to forward movement of the arm bands 12 and 14 as the arms and shoulders of a user are moved forward. With this device, additional exercise of the chest muscles may be obtained by connecting the arm bands 12 and 14 to elbow bands 54 and 56 respectively. Thus, the elbow band 54 is connected to the arm band 12 by one or more in elastic straps 58 while the elbow band 56 is connected to the arm band 14 by one or more in elastic straps 60. Thus, when the arms of the user are brought forward and crossed across the chest, additional stress is applied to the chest muscles of the user.

The straps 58 and 60 may be made adjustable by any conventional means, such as for example the hook and eye arrangement of FIG. 3. Thus, the ends of the straps 58 and 60 may be adjustably connected to the arm bands 12 and 14. Also, the elbow bands 54 and 56 may be made of elastic material in the same manner as the arm bands 12 and 14, but preferably the elbow bands are formed by in elastic material and are brought together and fastened at seams 62 and 64 by snaps, hook and eye fasteners, Velcro, or similar fastening means.

Figure 5:
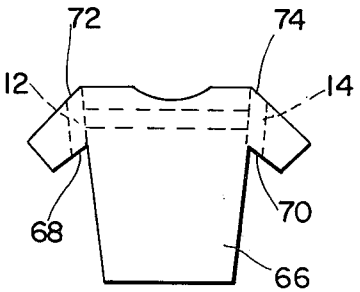
FIG. 5 is a front elevational view of a fourth embodiment of the chest muscle and posture developer of the present invention.

It is often very desirable to incorporate the chest muscle and posture developer of FIGS. 1-3 in a shirt, jacket, or similar garment which, when worn by the user, will cause the chest muscles to be exercised and the posture of the user to be improved. FIG. 5 discloses a shirt 66 having the arm bands 12 and 14 secured to the shirt in such a manner that the arm bands are positioned at the point where the sleeves meet the body of the shirt. Preferably, this attachment is accomplished by securing the arm bands at only one point to the shirt so that the remainder of the arm band is free from the shirt and may expand within the sleeves. This may be accomplished by sewing the arm bands under each arm of the shirt at points 68 and 70 to the seam that is normally present at this point of a shirt sleeve. It is also possible to attach the arm bands 12 and 14 at the top of the shirt sleeve at points 72 and 74 without deforming the shirt sleeve. There is no need to attach the back strap extending between the arm bands to the shirt, and in fact, such would normally be avoided to prevent deformation of the shirt from its normal shape.

For some applications, to facilitate laundering, the arm bands 12 and 14 might be attached to the shirt at points 68 and 70 and points 72 and 74 by removable fasteners such as snaps or similar fastening means. This would permit removal of the chest muscle and posture developer from the shirt structure.

The device according to this invention applies a force $F_d$, which acts to urge the arm bands together. The force $F_d$ is approximately equal to the force $F_e$, exerted by that elastic section with the least elastic force. This force $F_d$ is applied at the arms and shoulders in such a direction which counter acts the force applied by those muscles which are to be developed.

The chest muscle and posture developer exerts a force approximated by the equation:

$$F_e=(l_s-l_r)C.l_rl_sl_{max};$$

where:

$F_e$=force exerted by the sections $l_s$=length the section is stretched to $l_r$=length of the section in its relaxed state $l_{max}$=maximum length to which the section is designed to be stretched C=coefficient of elasticity of the section.

Thus the force of the device may be approximated by the equation:

$$F_d=F_{e(w)};$$

where $F_{e(w)}$ = force exerted by the section exerting the lowest force $F_e$.

The force of the device, in addition to being effective for developing muscles, also has a tendency to draw the shoulders back more than they would be without the device. Thus the device is useful for improving the user's posture while wearing the device, and for training the user to maintain an improved posture and poise.

It should be apparent that, by positioning the device so that the back sections are in front of the user over the clavicles, the back muscles can be developed.

While the user of the device according to this invention would produce more body heat with the device than without the device, the porosity of the device increases the ability of the body to cool itself through the natural transpirational process in the manner described previously. Therefore, to the extent that the porous portions of this device contact the user's body, the device according to this invention improves the user's comfort.

We claim:

1. An apparatus for use in developing the chest muscles and posture of a user without substantially developing the arm muscles of the user comprising at least two arm encircling means, a first of said arm encircling means being adapted to encircle the upper left arm and a second of the arm encircling means being adapted to encircle the upper right arm of the user, a back traversing means connected between said first and second arm encircling means, said back traversing means being elastically extensible to vary the distance between said first and second arm encircling means and including a first section formed of elastic material, a first inelastic connector extending between said first section and said first arm encircling means, said first inelastic connector being secured to said first section and to said first arm encircling means, and a second inelastic connector extending between said first section and said second arm encircling means, said second inelastic connector being secured to said first section and to said second arm encircling means.

2. The apparatus according to claim 1 which includes adjustment means for adjusting the length of said back traversing means to vary the distance between said first and second arm encircling means.

3. The apparatus according to claim 1 which includes a third arm encircling means, a third inelastic connector secured to said first and third arm encircling means and extending therebetween, a fourth arm encircling means, and a fourth inelastic connector secured to said second and fourth arm encircling means and extending therebetween.

4. The apparatus according to claim 1 wherein said first and second arm encircling means are each formed by a thin, flat, circular strap, said back traversing means being formed by a thin, flat elongated strap with said first section of elastic material being the central portion of said elongated strap and said first and second inelastic connectors forming the opposite ends of said elongated strap, said first and second inelastic connectors being connected respectively to the circular straps forming the first and second arm encircling means with said circular straps extending laterally from the same surface of the elongated strap, the longitudinal axis of said elongated strap extending from the circumference of the circle formed by each said circular strap and substantially perpendicular to the radius thereof.

5. An apparatus for use in developing the chest muscles and posture of a user without substantially developing the arm muscles of the user comprising a first arm encircling means adapted to encircle the upper left arm of a user adjacent the shoulder and a second arm encircling means adapted to encircle the right arm of a user adjacent the shoulder, said first and second arm encircling means each being formed by a thin, flat circular strap of substantial width, and a back traversing means connected between said first and second arm encircling means to span the back of a user and position said arm encircling means adjacent the user's shoulders, said back traversing means being elastically entensible and being formed by only one thin, flat, elongated strap of substantial width, the opposite ends of said elongated strap being secured respectively to a point on said first and second arm encircling means with the circular straps forming said first and second arm encircling means extending laterally from the same flat surface of said elongated strap, the longitudinal axis of said elongated strap extending from the circumference of the circle formed by each said circular strap and in a plane substantially perpendicular to the plane of the radius thereof.

6. The apparatus according to claim 1 wherein the back traversing means is formed from elastic material expandable only longitudinally in the direction of said first and second arm encircling means.

7. The apparatus according to claim 6 wherein the first and second arm encircling means are formed of elastic material, said elastic material being expandable only longitudinally, said arm encircling means expanding in a direction substantially perpendicular to the direction of expansion of said back traversing means.

8. The apparatus according to claim 7 wherein said flat elongated strap is a greater width than said circular straps, and said back traversing means includes adjustment means for varying the distance between said first and second arm encircling means.

9. The apparatus according to claim 1 wherein said back traversing means is formed of an open web-like material to aid the natural transpirational cooling of a wearer.

10. The apparatus according to claim 9 wherein said arm encircling means are formed of an open web-like material to facilitate the natural transpirational cooling of a wearer.

11. The apparatus according to claim 1 wherein said back traversing means includes a first section having a first end secured to said first arm encircling means and a second end having first fastener means provided thereon, and a second section having a first end secured to said second arm encircling means and a second end having second fastener means provided thereon, said first and second fastener means cooperating to secure said first and second sections together and to adjust the length of said back traversing means.

12. The apparatus according to claim 1 wherein said back traversing means includes a strap having a first end secured to said first arm encircling means and a second end having first fastener means provided thereon, said second arm encircling means having second fastener means provided thereon, said first and second fastener means cooperating to secure said second end to said second arm encircling means and to adjust the distance between said first and second arm encircling means.

* * * * *